US009340957B2

(12) United States Patent
Magaki et al.

(10) Patent No.: US 9,340,957 B2
(45) Date of Patent: May 17, 2016

(54) SHOVEL INCLUDING A DISPLAY DEVICE

(71) Applicant: SUMITOMO(S.H.I.) CONSTRUCTION MACHINERY CO., LTD., Tokyo (JP)

(72) Inventors: Hideto Magaki, Chiba (JP); Kiminori Sano, Chiba (JP); Ryota Kurosawa, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 124 days.

(21) Appl. No.: 14/170,735

(22) Filed: Feb. 3, 2014

(65) Prior Publication Data

US 2014/0297106 A1 Oct. 2, 2014

(30) Foreign Application Priority Data

Mar. 27, 2013 (JP) ..... 2013-067624

(51) Int. Cl.
*E02F 9/26* (2006.01)

(52) U.S. Cl.
CPC ..... *E02F 9/26* (2013.01)

(58) Field of Classification Search
None
See application file for complete search history.

(56) References Cited

U.S. PATENT DOCUMENTS

| | | | | |
|---|---|---|---|---|
| 7,483,814 | B2 | 1/2009 | Hoshi et al. | |
| 2010/0228416 | A1* | 9/2010 | Sugiyama | 701/22 |
| 2011/0276261 | A1* | 11/2011 | Mizutani | 701/123 |
| 2012/0245760 | A1 | 9/2012 | Ikeya | |
| 2013/0066527 | A1* | 3/2013 | Mizuochi et al. | 701/50 |

FOREIGN PATENT DOCUMENTS

| | | |
|---|---|---|
| GB | 2405136 | 2/2005 |
| JP | 2005-098988 | 4/2005 |
| JP | 2007288894 | 11/2007 |

OTHER PUBLICATIONS

Extended European Search Report dated Oct. 8, 2014.

* cited by examiner

*Primary Examiner* — John R Olszewski
*Assistant Examiner* — James M McPherson
(74) *Attorney, Agent, or Firm* — IPUSA, LLC

(57) ABSTRACT

A shovel includes a cabin in which a display monitor is provided, an upper-part turnable body that includes the cabin, an electric turning mechanism that causes the upper-part turnable body to turn, a turning electric motor that drives the electric turning mechanism, a detector that detects the state of driving of the electric turning mechanism, and a display control part configured to generate information to be displayed on the display monitor and cause the display monitor to display the generated information. The display control part is configured to calculate a physical quantity pertaining to an operation of the turning electric motor based on a detection value of the detector, generate turning operation display data for graphically representing the calculated physical quantity, and cause the display monitor to graphically display the generated turning operation display data.

12 Claims, 7 Drawing Sheets

200

300

SHOVEL INCLUDING A DISPLAY DEVICE

CROSS-REFERENCE TO RELATED APPLICATION

This application is based upon and claims the benefit of priority of Japanese Patent Application No. 2013-067624, filed on Mar. 27, 2013, the entire contents of which are incorporated herein by reference.

BACKGROUND

1. Technical Field

The present invention relates to shovels including a display unit that displays an operating condition.

2. Description of Related Art

Shovels commonly have a display monitor provided in their cabins. It is possible for an operator of a shovel to check the operating condition of the shovel at the time by looking at a screen on the display monitor. For example, a construction machine has been proposed that includes a display part configured to perform such display as to make it possible to determine a difference between measured engine fuel efficiency and set engine fuel efficiency.

SUMMARY

According to an aspect of the present invention, a shovel includes a cabin in which a display monitor is provided, an upper-part turnable body that includes the cabin, an electric turning mechanism that causes the upper-part turnable body to turn, a turning electric motor that drives the electric turning mechanism, a detector that detects the state of driving of the electric turning mechanism, and a display control part configured to generate information to be displayed on the display monitor and cause the display monitor to display the generated information. The display control part is configured to calculate a physical quantity pertaining to an operation of the turning electric motor based on a detection value of the detector, generate turning operation display data for graphically representing the calculated physical quantity, and cause the display monitor to graphically display the generated turning operation display data.

It is to be understood that both the foregoing general description and the following detailed description are exemplary and explanatory and not restrictive of the invention.

DETAILED DESCRIPTION

According to shovels of related art, a display unit displays a single content per screen. In order to cause such a display unit to display multiple contents, it is required to switch the screen of the display unit. Therefore, the operator is required to release her/his hand from an operation lever when the operator desires to switch the screen to display another content. During shovel work, however, it is impossible for the operator to release her/his hand from the operation lever. Therefore, it is impossible to switch the screen and thus to view a desired content during shovel work.

During shovel work, the operator monitors the basic condition of the shovel displayed on a basic screen and is prevented from viewing a screen that displays information on engine fuel efficiency, for example. Accordingly, it is impossible to provide the operator with information (a content) regarding the fuel efficiency of the shovel while the operator is operating the shovel. Therefore, the operator is prevented from operating the shovel while considering engine fuel efficiency.

Furthermore, during shovel work, the operator monitors the basic condition of the shovel displayed on a basic screen and is prevented from viewing a screen that displays information on power consumption or regenerated electric power in turning operations, for example. Accordingly, it is impossible to provide the operator with information (a content) regarding turning operations while the operator is operating the shovel. Therefore, the operator is prevented from performing turning operations while considering energy efficiency.

According to an aspect of the present invention, a shovel is provided that is capable of encouraging an operator to perform efficient turning operations during shovel work.

According to an aspect of the present invention, it is possible to encourage an operator at work to perform efficient turning operations by graphically displaying information including physical quantities related to the operations of a turning electric motor.

A description is given below, with reference to the accompanying drawings, of embodiments of the present invention.

Figure 1:
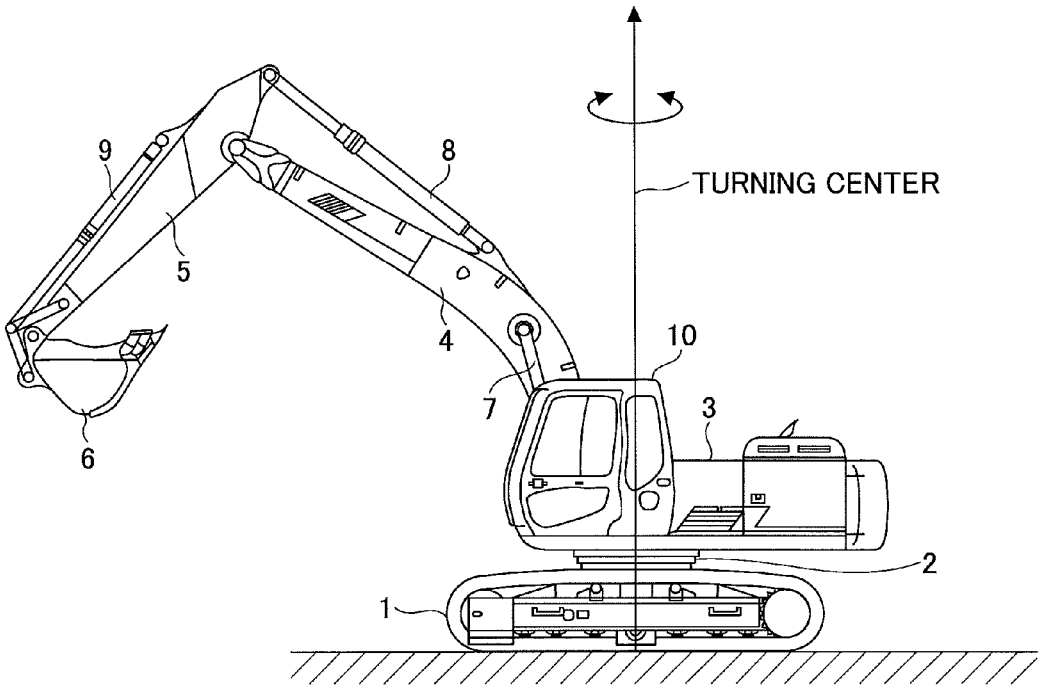
FIG. 1 is a side view of a shovel according to an embodiment.

FIG. 1 is a side view of a shovel according to an embodiment. The shovel illustrated in FIG. 1 is a hybrid shovel. Embodiments of the present invention, however, may be applied to not only hybrid shovels but also any kinds of shovels as long as the shovels include an electrical energy storage device as a power supply for driving an electrical load.

Referring to FIG. 1, an upper-part turning body 3 (an upper-part turnable body) is mounted through an electric turning mechanism 2 on a lower-part traveling body 1 (a lower-part movable body) of the shovel. A boom 4, an arm 5, a bucket 6, and a boom cylinder 7, an arm cylinder 8, and a bucket cylinder 9 for hydraulically driving the boom 4, the arm 5, and the bucket 6, respectively, are provided on the upper-part turning body 3. Furthermore, a cabin 10 and power sources are mounted on the upper-part turning body 3.

Figure 2:
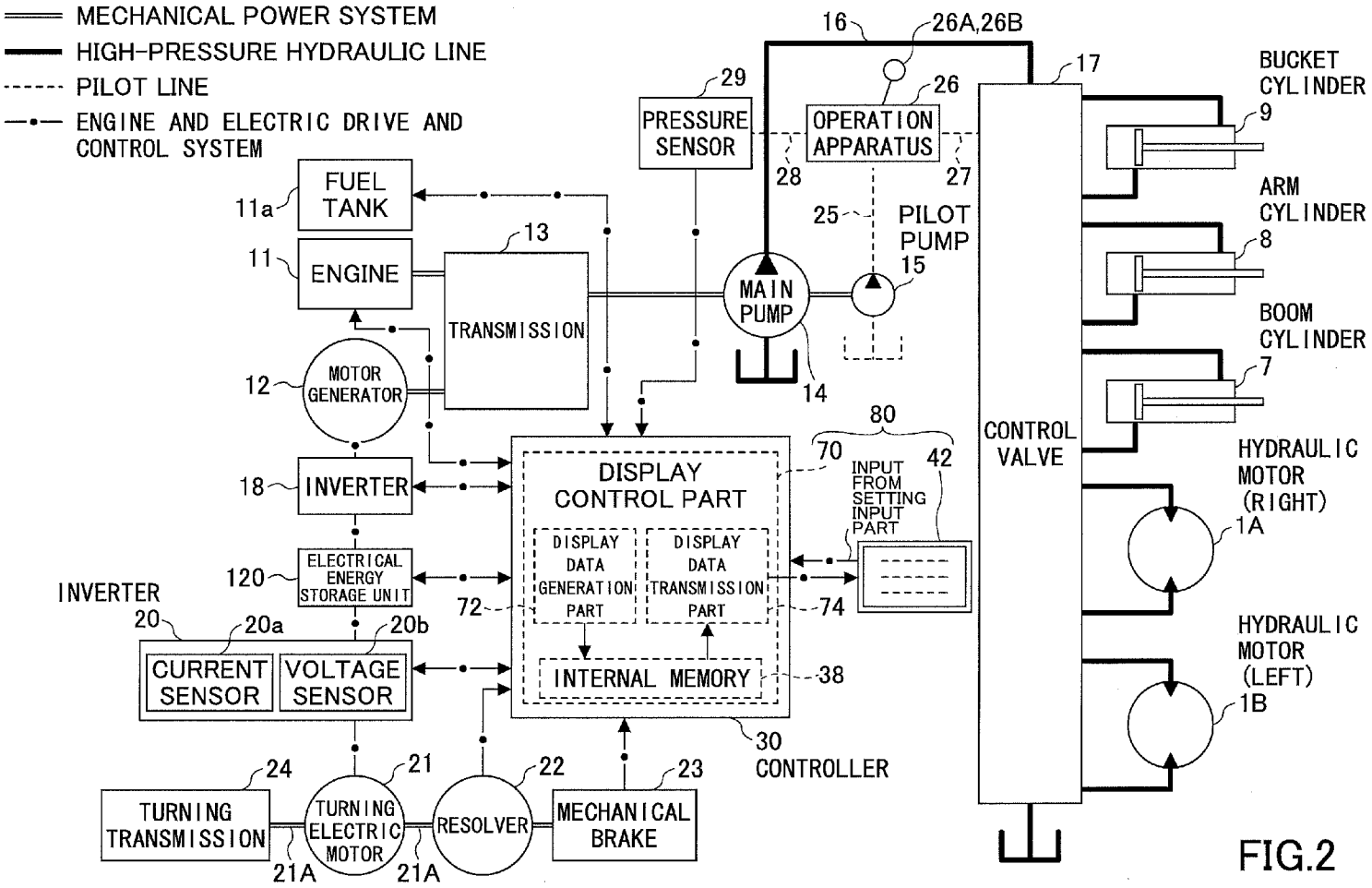
FIG. 2 is a block diagram illustrating a configuration of a drive system of the shovel illustrated in FIG. 1 according to an embodiment.

FIG. 2 is a block diagram illustrating a configuration of a drive system of the shovel illustrated in FIG. 1 according to an embodiment. In FIG. 2, a mechanical power system, a high-pressure hydraulic line, a pilot line, and an engine and electric drive and control system are indicated by a double line, a solid line, a broken line, and a dot-dash line, respectively.

An engine 11 as a mechanical drive part and a motor generator 12 as an assist drive part are connected to a first input shaft and a second input shaft, respectively, of a transmission 13. A main pump 14 and a pilot pump 15 are connected to the output shaft of the transmission 13. A control valve 17 is connected to the main pump 14 via a high-pressure hydraulic line 16.

The control valve 17 is a control unit that controls a hydraulic system of the shovel. Hydraulic motors 1A (right) and 1B (left) for the lower-part traveling body 1, the boom cylinder 7, the arm cylinder 8, and the bucket cylinder 9 are connected to the control valve 17 via high-pressure hydraulic lines.

An electrical energy storage unit 120 including an electrical energy storage device, which is a capacitor or a battery for storing electrical energy, is connected to the motor generator 12 via an inverter 18. According to this embodiment, it is assumed that the electrical energy storage unit 120 includes a capacitor such as an electric double-layer capacitor (EDLC) as the electrical energy storage device. Furthermore, a turning electric motor 21 is connected to the electrical energy storage unit 120 via an inverter 20. A capacitor is illustrated above as an example of the electrical energy storage device. Alternatively, in place of the capacitor, a rechargeable battery, which is chargeable and dischargeable, such as a lithium ion battery (LIB), or other form of power supply capable of transferring and receiving electric power may be used as the electrical energy storage device.

A resolver 22, a mechanical brake 23, and a turning transmission 24 are connected to a rotating shaft 21A of the turning electric motor 21, which drives the electric turning mechanism 2. Furthermore, an operation apparatus 26 is connected to the pilot pump 15 via a pilot line 25.

The control valve 17 and a pressure sensor 29 as a lever operation detecting part are connected to the operation apparatus 26 via hydraulic lines 27 and 28, respectively. A controller 30 that controls the driving of an electric system is connected to the pressure sensor 29.

As described above, the inverter 18 is provided between the motor generator 12 and the electrical energy storage unit 120. The inverter 18 controls the operation of the motor generator 12 based on commands from the controller 30. This makes it possible for the inverter 18 to supply electric power from the electrical energy storage unit 120 to the motor generator 12 when the motor generator 12 performs a power running operation, and to store the electric power generated by the motor generator 12 in the electrical energy storage device of the electrical energy storage unit 120 when the motor generator 12 performs a regenerative operation.

The electrical energy storage unit 120 is provided between the inverter 18 and the inverter 20. This makes it possible for the electrical energy storage unit 120 to supply electric power for a power running operation when at least one of the motor generator 12 and the turning electric motor 21 performs a power running operation, and to store the electric power regenerated by a regenerative operation as electrical energy when at least one of the motor generator 12 and the turning electric motor 21 performs a regenerative operation.

As described above, the inverter 20 is provided between the turning electric motor 21 and the electrical energy storage unit 120. The inverter 20 controls the operation of the turning electric motor 21 based on commands from the controller 30. This makes it possible for the inverter 20 to supply electric power from the electrical energy storage unit 120 to the turning electric motor 21 when the turning electric motor 21 performs a power running operation, and to store the electric power generated by the turning electric motor 21 in the electrical energy storage device of the electrical energy storage unit 120 when the turning electric motor 21 performs a regenerative operation.

The charge and discharge of the electrical energy storage device of the electrical energy storage unit 120 is controlled by the controller 30 based on the state of charge of the electrical energy storage device, the operating state (power running operation or regenerative operation) of the motor generator 12, and the operating state (power running operation or regenerative operation) of the turning electric motor 21.

Furthermore, the inverter 20 includes a current sensor 20*a* and a voltage sensor 20*b*.

The controller 30 is a control unit serving as a main control part that controls the driving of the hybrid shovel. The controller 30 includes a processor including a central processing unit (CPU) and an internal memory 38 (FIG. 2). The controller 30 is a device implemented by the CPU executing a drive control program contained in the internal memory 38.

The controller 30 converts a signal fed from the pressure sensor 29 into a speed command, and controls the driving of the turning electric motor 21. The signal fed from the pressure sensor 29 corresponds to a signal that represents the amount of operation in the case of operating the operation apparatus 26 in order to cause the electric turning mechanism 2 to turn.

The controller 30 controls the operation (switches the electric motor [assist] operation and the generator operation) of the motor generator 12, and controls the charge and discharge of the electrical energy storage device by controlling the driving of a step-up/step-down converter 100 (FIG. 3) of the electrical energy storage unit 120. The controller 30 controls the charge and discharge of the electrical energy storage device by controlling the switching of the step-up operation and the step-down operation of the step-up/step-down converter 100 of the electrical energy storage unit 120 based on the state of charge of the electrical energy storage device, the operating state (electric motor [assist] operation or generator operation) of the motor generator 12, and the operating state (power running operation or regenerative operation) of the turning electric motor 21. Furthermore, the controller 30 also controls the amount of charging the electrical energy storage device (charging current or charging electric power) as described below.

The controller 30 transmits or receives the water temperature of the cooling water of the engine 11, a command value of the amount of fuel injection of the engine 11, and the usage condition of an exhaust gas filter (DPF regenerator) through a communication circuit provided between the controller 30 and the engine 11. Furthermore, the controller 30 receives the level of remaining fuel measured with a fuel gauge provided in a fuel tank 11*a* through a communication circuit provided between the controller 30 and the fuel tank 11*a*. Furthermore, the controller 30 receives information on the condition of settings of the shovel input from a setting input part (a display monitor 42) described below by an operator, through a communication circuit provided between the controller 30 and the setting input part.

Figure 3:
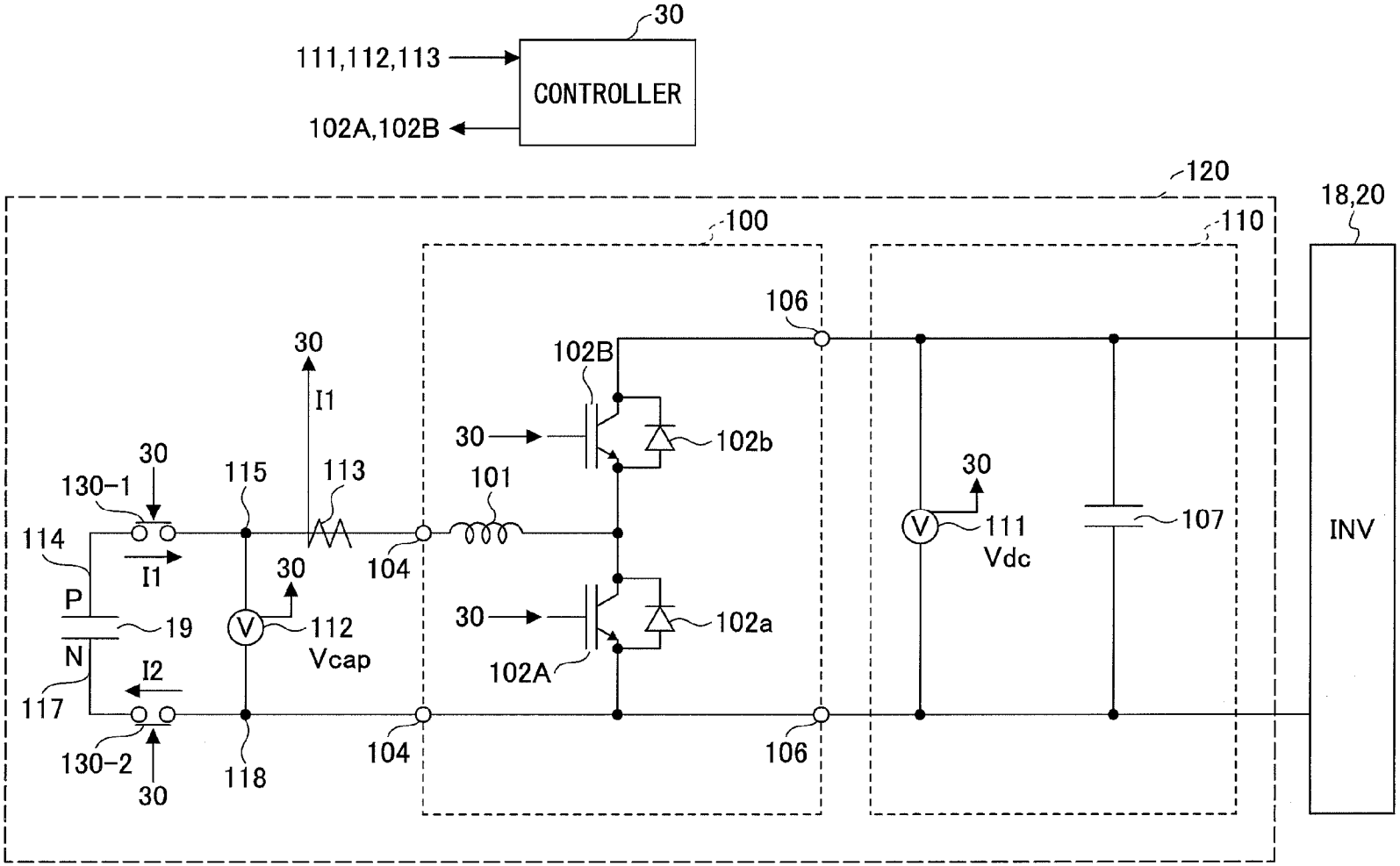
FIG. 3 is a circuit diagram of an electrical energy storage unit according to an embodiment.

FIG. 3 is a circuit diagram of the electrical energy storage unit 120 according to an embodiment. The electrical energy storage unit 120 includes a capacitor 19 as an electrical energy storage device, the step-up/step-down converter 100, and a DC bus 110. The DC bus 110 controls the transfer of electric power among the capacitor 19, the motor generator 12, and the turning electric motor 21. The capacitor 19 is provided with a capacitor voltage detecting part 112 for detecting a capacitor voltage value and a capacitor current detecting part 113 for detecting a capacitor current value. The capacitor voltage value detected by the capacitor voltage detecting part 112 and the capacitor current value detected by the capacitor current detecting part 113 are fed to the controller 30.

The step-up/step-down converter 100 performs such control as the switching of a step-up operation and a step-down operation in accordance with the operating states of the motor generator 12 and the turning electric motor 21, so that the DC bus voltage value falls within a certain range. The DC bus 110 is provided between the inverters 18 and 20 and the step-up/step-down converter 100 to transfer electric power among the capacitor 19, the motor generator 12, and the turning electric motor 21.

The switching of the step-up operation and the step-down operation of the step-up/step-down converter 100 is controlled based on the DC bus voltage value detected by a DC bus voltage detecting part 111, the capacitor voltage value detected by the capacitor voltage detecting part 112, and the capacitor current value detected by the capacitor current detecting part 113.

In the configuration as described above, the electric power generated by the motor generator 12, which is an assist motor, is supplied to the DC bus 110 of the electrical energy storage unit 120 via the inverter 18 to be supplied to the capacitor 19 via the step-up/step-down converter 100. The electric power regenerated by the regenerative operation of the turning electric motor 21 is supplied to the DC bus 110 of the electrical energy storage unit 120 via the inverter 20 to be supplied to the capacitor 19 via the step-up/step-down converter 100.

The step-up/step-down converter 100 includes a reactor 101, a step-up IGBT (Insulated Gate Bipolar Transistor) 102A, a step-down IGBT 102B, power supply connection terminals 104 for connecting the capacitor 19, and output terminals 106 for connecting the inverters 18 and 20. The output terminals 106 of the step-up/step-down converter 100 and the inverters 18 and 20 are connected by the DC bus 110.

The reactor 101 has one end connected to a point between the step-up IGBT 102A and the step-down IGBT 102B and has the other end connected to one of the power supply connection terminals 104. The reactor 101 is provided to supply the DC bus 110 with the induced electromotive power generated with the turning-on/off of the step-up IGBT 102A.

The step-up IGBT 102A and the step-down IGBT 102B, which are constituted of bipolar transistors each having a MOSFET (Metal Oxide Semiconductor Field Effect Transistor) incorporated into its gate part, are semiconductor devices (switching elements) capable of high-speed switching with high power. The step-up IGBT 102A and the step-down IGBT 102B are driven by application of PWM voltage to their gate terminals by the controller 30. Diodes 102*a* and 102*b*, which are rectifying elements, are connected in parallel to the step-up IGBT 102A and the step-down IGBT 102B, respectively.

The capacitor 19 may be a chargeable and dischargeable electrical energy storage device so as to enable transfer of electric power to and from the DC bus 110 via the step-up/step-down converter 100. In FIG. 3, the capacitor 19 is illustrated as an electrical energy storage device. Alternatively, in place of the capacitor 19, a rechargeable battery, which is chargeable and dischargeable, such as a lithium ion battery, or other form of power supply capable of transferring and receiving electric power may be used.

The power supply connection terminals 104 may be terminals to which the capacitor 19 may be connected, and the output terminals 106 may be terminals to which the inverters 18 and 20 may be connected. The capacitor voltage detecting part 112 that detects the capacitor voltage is connected between the paired power supply connection terminals 104. The DC bus voltage detecting part 111 that detects the DC bus voltage is connected between the paired output terminals 106.

The capacitor voltage detecting part 112 detects the voltage value Vcap of the capacitor 19. The DC bus voltage detecting part 111 detects the voltage value Vdc of the DC bus 110. A smoothing capacitor 107 is an electrical energy storage element inserted between the positive and the negative output terminal 106 to smooth the DC bus voltage. The voltage of the DC bus 110 is maintained at a predetermined voltage by this smoothing capacitor 107.

The capacitor current detecting part 113 is a detecting part that detects the value of an electric current flowing through the capacitor 19 on the positive terminal (P terminal) side of the capacitor 19. That is, the capacitor current detecting part 113 detects the value of an electric current I1 that flows through the positive terminal of the capacitor 19.

In the step-up/step-down converter 100, at the time of raising the voltage of the DC bus 110, a PWM voltage is applied to the gate terminal of the step-up IGBT 102A, so that the induced electromotive force generated in the reactor 101 with the turning-on/off of the step-up IGBT 102A is supplied to the DC bus 110 via the diode 102*b* connected in parallel to the step-down IGBT 102B. As a result, the voltage of the DC bus 110 is raised.

At the time of lowering the voltage of the DC bus 110, a PWM voltage is applied to the gate terminal of the step-down IGBT 102B, so that regenerated electric power supplied via the inverter 18 or 20 is supplied from the DC bus 110 to the capacitor 19 via the step-down IGBT 102B. As a result, the capacitor 19 is charged with the electric power stored in the DC bus 110, so that the voltage of the DC bus 110 is lowered.

According to this embodiment, in a power supply line 114 that connects the positive terminal of the capacitor 19 to the one of the power supply connection terminals 104 of the step-up/step-down converter 100, a relay 130-1 is provided as a breaker capable of breaking the power supply line 114. The relay 130-1 is placed between a connecting point 115, where the capacitor voltage detecting part 112 is connected to the power supply line 114, and the positive terminal of the capacitor 19. The relay 130-1 is caused to operate by a signal from the controller 30, and is capable of disconnecting the capacitor 19 from the step-up/step-down converter 100 by breaking the power supply line 114 from the capacitor 19.

Furthermore, in a power supply line 117 that connects the negative terminal of the capacitor 19 to the other of the power supply connection terminals 104 of the step-up/step-down converter 100, a relay 130-2 is provided as a breaker capable of breaking the power supply line 117. The relay 130-2 is placed between a connecting point 118, where the capacitor voltage detecting part 112 is connected to the power supply line 117, and the negative terminal of the capacitor 19. The relay 130-2 is caused to operate by a signal from the controller 30, and is capable of disconnecting the capacitor 19 from the step-up/step-down converter 100 by breaking the power supply line 117 from the capacitor 19. The capacitor 19 may be disconnected by breaking both the power supply line 114 on the positive terminal side and the power supply line 117 on the negative terminal side simultaneously, forming the relay 130-1 and the relay 130-2 as a single relay.

In practice, there is a drive part that generates PWM signals to drive the step-up IGBT 102A and the step-down IGBT 102B between the controller 30 and the step-up IGBT 102A and the step-down IGBT 102B. In FIG. 3, however, the drive part is omitted. Such a drive part may be implemented by either an electronic circuit or a processor.

Figure 4:
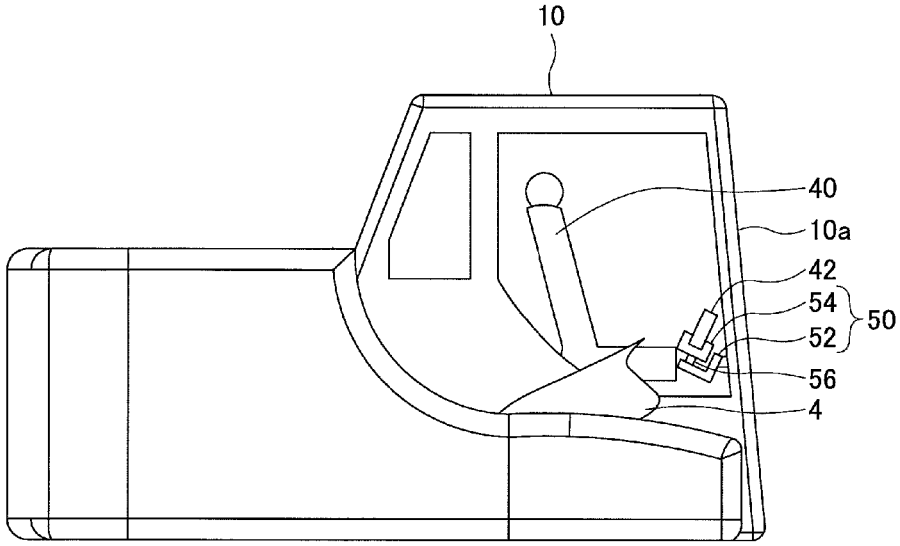
FIG. 4 is a perspective view of a cabin, illustrating its interior, according to an embodiment.
Figure 5:
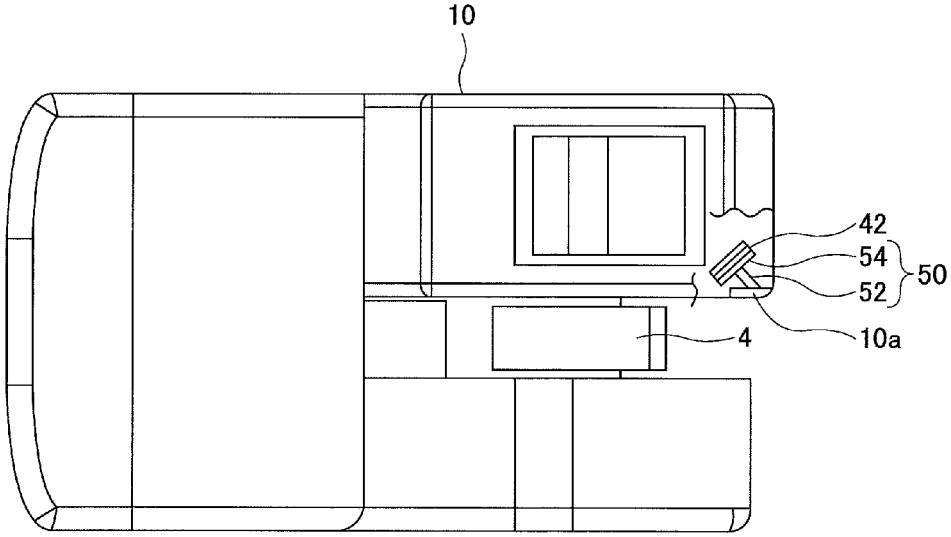
FIG. 5 is a plan view of the cabin in which a display monitor is provided according to an embodiment.

FIG. 4 is a side view of the cabin 10, illustrating its interior, according to an embodiment. FIG. 5 is a plan view of the cabin 10, in which a display monitor is provided, according to an embodiment.

An operator's seat 40 is provided inside the cabin 10, and the display monitor 42 is placed near the operator's seat 40. It is possible for an operator seated on the operator's seat 40 to understand the state of each part of the shovel by viewing the display monitor 42 while operating operation levers 26A and 26B (FIG. 2). As described below, various kinds of information (contents) are displayed on the display monitor 42 by a display control part 70 (FIG. 1).

An attachment part 50 for attaching the display monitor 42 includes an installation base 52 and a mount part 54 supported by the installation base 52. The installation base 52 is attached and fixed to a frame 10*a* of the cabin 10, in which the operator's seat 40 is provided. The mount part 54 is supported on the installation base 52 through a damping mechanism 56, which includes an elastic body such as a spring or rubber, so as to prevent direct transmission of vibrations of or impact on the cabin 10 to the mount part 54 via the installation base 52. That is, the mount part 54 is supported on the installation base 52 through the damping mechanism 56, so that vibrations of or impact on the cabin 10 transmitted to the display monitor 42 fixed to the mount part 54 is reduced.

In general, the boom 4 is disposed on the right side as viewed from the operator seated on the operator's seat 40, and the operator often operates the shovel while viewing the arm 5 attached to the end of the boom 4 or the bucket 6 attached to the arm 5. The frame 10*a*, which is on the front right side of the cabin 10, is a part that obstructs the operator's view. According to this embodiment, the attachment part 50 of the display monitor 42 is provided using this part. Thus, because the display monitor 42 is placed on the part that is an obstruction to the view from the beginning, the display monitor 42 itself does not obstruct the operator's view. Depending on the width of the frame 10*a*, it is preferable to determine the size of the display monitor 42 so that the entire display monitor 42 fits in the width of the frame 10*a*.

According to this embodiment, a display unit such as an LCD touchscreen panel is employed as the display monitor 42. Alternatively, a portable terminal (a multifunction portable information terminal) may be used as a display unit.

Next, a description is given of a display unit according to an embodiment. Referring to FIG. 2, a display unit 80 according to an embodiment includes the display control part 70 of the controller 30 and the display monitor 42 provided inside the cabin 10. The display control part 70 is a functional element that is implemented by the CPU of the controller 30 executing a display control program contained in the internal memory 38.

As illustrated in FIG. 2, the display control part 70 of the controller 30 includes a display data generation part 72 and a display data transmission part 74.

The display data generation part 72 creates display data that are displayed on the display monitor 42 based on detection values from various sensors (detectors) transmitted to the controller 30 and stored information (data). The display data generation part 72 stores created display data in the internal memory 38 of the controller 30. The display data transmission part 74 reads display data stored in the internal memory 38 and suitably transmits the read display data to the display monitor 42.

In response to reception of the display data, the display monitor 42 displays a screen based on the display data. It is possible for the operator to obtain various kinds of information including the condition of the shovel by viewing the screen of the display monitor 42.

According to this embodiment, the display monitor 42 also operates as a setting input part. As described above, an LCD touchscreen panel or the like is employed as the display monitor 42, and information regarding the condition of settings (setting condition) of the shovel, such as a work mode, may be input from the display monitor 42 by the operator.

According to this embodiment, the display monitor 42 also operates as a setting input part. Alternatively, for example, in the case of not using a touchscreen panel as the display monitor 42, a setting input part may be provided separately from the display monitor 42. Furthermore, a touchscreen panel that also operates as a setting input part and a setting input part provided separately from the touchscreen panel may be combined, so that different setting input parts may be used depending on the contents of settings.

Figure 6:
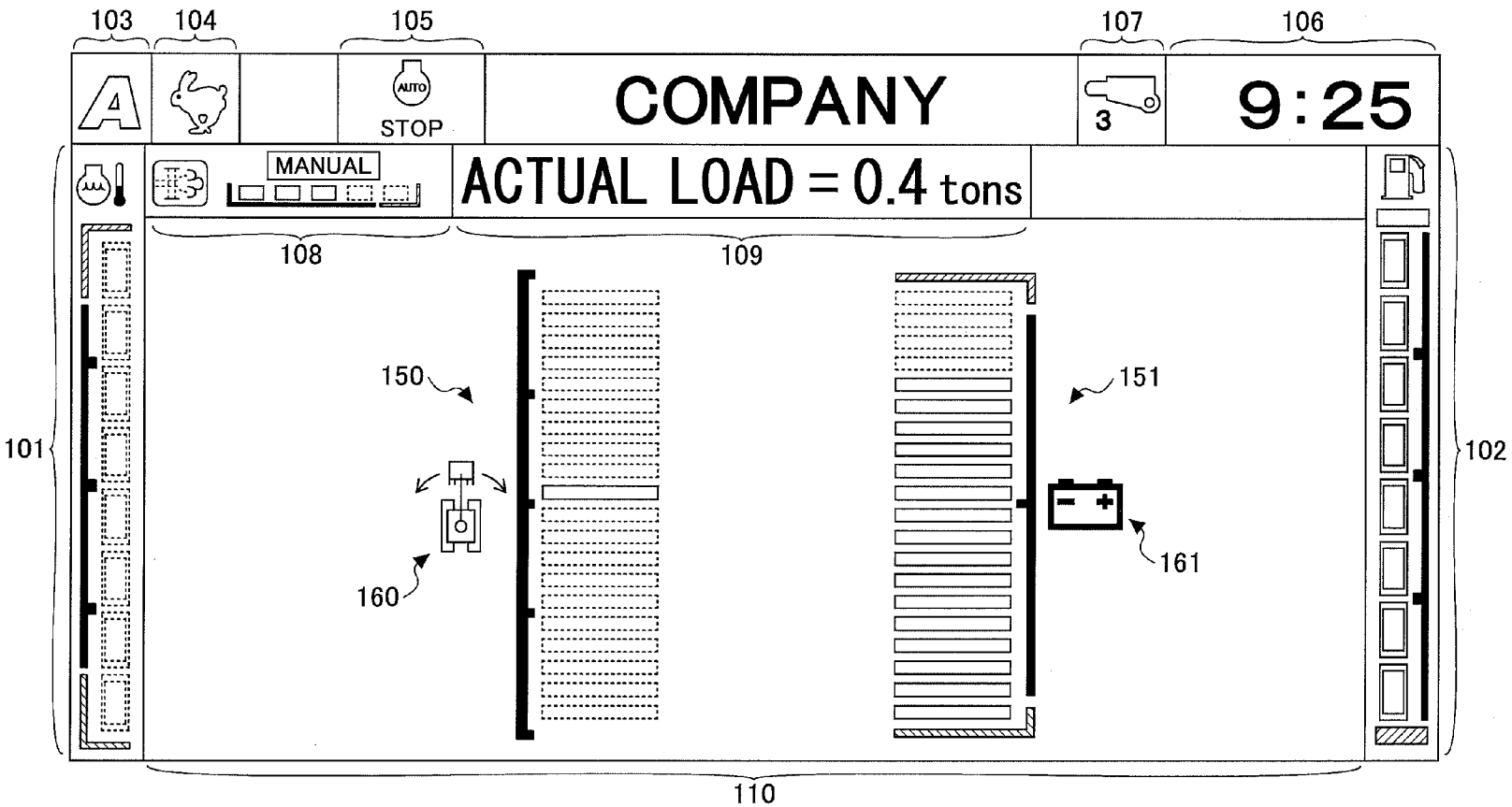
FIG. 6 is a diagram illustrating a screen displayed on the display monitor according to an embodiment.

Next, a description is given of information (contents) that a display unit displays on the display monitor 42 according to an embodiment. FIG. 6 is a diagram illustrating a screen displayed on the display monitor 42.

On a rectangular display screen 100 illustrated in FIG. 6, the water temperature of the engine 11 is displayed on a multilevel scale in a region 101 along the left side. Furthermore, the remaining amount of fuel stored in the fuel tank 11*a* is displayed on a multilevel scale in a region 102 along the right side. The engine water temperature and the remaining amount of fuel, which are information items to be constantly observed by the operator, correspond to information on the operating condition of the shovel.

The water temperature of the engine 11 displayed in the region 101 is information obtained from the engine 11 via the above-described communication circuit by the controller 30. Furthermore, the remaining amount of fuel displayed in the region 102 is information obtained from the fuel gauge of the fuel tank 11*a* via the above-described communication circuit by the controller 30.

A work mode that is currently set for the shovel is displayed in a region 103 at the left end of a region along the upper side of the display screen 100. The work mode is a mode for limiting the output of the shovel. For example, one of an automatic mode "A," a heavy mode "H," and a superpower mode "SP" is set as the work mode. The automatic mode "A" is a power save mode, in which the shovel is operated in such a manner as to reduce engine fuel consumption. The heavy mode "H" is a mode to increase engine output to make it possible to do heavy work. The superpower mode "SP" is a mode for temporarily exerting a large work force by further increasing engine output from that of the heavy mode "H." In the case illustrated in FIG. 6, "A" is displayed, so that it is possible for the operator to recognize that the power save mode is set.

In a region 104 on the right side next to the region 103, where the work mode is indicated, a traveling mode is displayed as the setting mode of traveling hydraulic motors using a variable displacement pump. The traveling mode includes a low-speed mode and a high-speed mode. The low-speed mode is displayed using a mark in the shape of a "tortoise" and the high-speed mode is displayed with a mark in the shape of a "rabbit." In the case illustrated in FIG. 6, the mark in the shape of a "rabbit" is displayed, so that it is possible for the operator to recognize that the high-speed mode is set.

In a region 105 on the right side next to the region 104, where the traveling mode is displayed, the stopped/operating state of the engine 11 is displayed. In the case illustrated in FIG. 6, "STOP" is displayed to indicate that the engine 11 is stopped.

In a region 106 at the right end of the region along the upper side of the display screen 100, a current time is displayed. In the case illustrated in FIG. 6, it is indicated that the current time is 9:25.

In a region 107 on the left side next to the time display region 106, a currently attached attachment is displayed. Attachments attachable to the shovel include various attachments such as a bucket, a rock drill, a grapple, and a lifting magnet. In the region 107, marks in the shape of these attachments and numbers corresponding to the attachments are displayed. In the case illustrated in FIG. 6, a mark in the shape of a rock drill is displayed, and "3" is displayed as a number indicating the magnitude of the output of the rock drill.

Other information may be displayed in a region between the region 105 and the region 107. For example, the name of a manufacturer of the shovel may be displayed as other information. Furthermore, the information displayed in the above-described regions 103, 104, 105, and 107 is information input from the setting input part (display monitor 42) and obtained by the controller 30 via the above-described communication circuit.

In a region 108 under the region 104 and the region 105, the operating time of an exhaust gas filter is displayed. Furthermore, in an upper part of the region 108, a setting as to whether to remove captured matter automatically or manually is displayed.

The operating time of an exhaust gas filter and so on displayed in the region 108 are information items obtained from the engine 11 via the above-described communication circuit by the controller 30.

In a region 109 on the right side next to the region 108, a load applied to the end of the arm 5 is numerically displayed. In the case illustrated in FIG. 6, "ACTUAL LOAD=0.4 tons" is displayed in the region 109, so that it is possible to know that the load applied to the end of the arm 5 is 0.4 tons.

The load applied to the end of the arm 5 displayed in the region 109 is information obtained from a hydraulic sensor (not illustrated) by the controller 30.

The above-described information displayed in the regions 101 through 109 indicates the operating condition and the setting condition of the shovel. That is, the information displayed in the regions 101, 102, 108, and 109 is information on the operating condition of the shovel, and the information displayed in the regions 103, 104, 105, and 107 is information on the setting condition of the shovel. The information on the operating condition and the setting condition of the shovel is standard information displayed on the display screen 100.

According to this embodiment, additional information other than the above-described display information is displayed in a region 110. According to this embodiment, the shape of the shovel as viewed from above is depicted in a schematic diagram 160 and the turning directions are indicated by arrows in the region 110 in order to help visually understand the turning directions. Beside the schematic diagram 160 of the shovel, information on a physical quantity such as the output of the turning electric motor 21 is graphically displayed. According to this embodiment, the information displayed in the region 110 is information on the condition of the drive part of the shovel.

In the case illustrated in FIG. 6, the output of the turning electric motor 21 is expressed on a twenty-level scale in a bar graph 150 extending vertically on the screen. The vertical center of the bar graph 150 corresponds to a zero output, at which the turning electric motor 21 performs neither a power running operation nor a regenerative operation (generator operation). In the part above the zero output, the magnitude of the output of the turning electric motor 21 in the power running operation is expressed on a ten-level scale. Going upward from the center indicates an increase in the output (energy, which may be expressed by consumed electric power or consumed electric current) of the turning electric motor 21 for causing the electric turning mechanism 2 to turn. On the other hand, in the part below the zero output, the magnitude of the output of the turning electric motor 21 in the regenerative operation is expressed on a ten-level scale. Going downward from the center indicates an increase in the output (energy, which may be expressed by generated electric power or generated electric current) of the turning electric motor 21 by the regenerative operation.

The output (energy) of the turning electric motor 21 displayed in the region 110 is determined based on the current value detected from the current sensor 20*a* of the inverter 20 or based on the current value and the voltage value detected from both the current sensor 20*a* and the voltage sensor 20*b* of the inverter 20.

As described above, when the turning electric motor 21 is in the power running operation, the magnitude of consumed electric power or consumed electric current is expressed on a multilevel scale as an output. On the other hand, when the turning electric motor 21 is in the regenerative operation, the magnitude of generated electric power or generated electric current is expressed on a multilevel scale as an output. Accordingly, the output of the turning electric motor 21 in this specification corresponds to a physical quantity pertaining to the power running operation or the regenerative operation of the turning electric motor 21.

The above-described graphical display of the output of the turning electric motor 21 allows the operator to instantaneously visually understand how much electric power is consumed or how much electric power is generated by a turning operation currently performed. This makes it possible for the operator to, for example, determine the appropriateness of the operator's turning operation in light of energy saving and to learn an appropriate turning lever operation in light of energy saving.

In the region 110 of the display screen 100 of the display monitor 42, the output of the turning electric motor 21 is constantly graphically displayed as a basic screen. Therefore, it is always possible for the operator to view the graphical display of the output of the turning electric motor 21 without releasing her/his hand from an operation lever. Furthermore, because basic information pertaining to the operating condition and the setting condition of the shovel also is displayed on the basic screen, it is possible for the operator to check the output of the turning electric motor 21 substantially simultaneously while checking the basic information. Thus, the convenience of the display unit 80 is increased.

According to this embodiment, in addition to the above-described graphical display of the output of the turning electric motor 21, the state of charge of the capacitor 19 also is graphically displayed on a multilevel scale. As illustrated in FIG. 6, the state of charge of the capacitor 19 is displayed beside the graphical display of the output of the turning electric motor 21 in the region 110. A schematic diagram 161 in the shape of an electrical energy storage device is displayed near the graphical display (bar graph 151) of the state of charge of the capacitor 19. This helps visually determine that the graphical display is a display of the state of charge of the capacitor 19.

The state of charge of the capacitor 19 is determined based on the voltage value detected in the capacitor voltage detecting part 112.

In the case illustrated in FIG. 6, the graphical display of the state of charge of the capacitor 19 is divided into twenty bars (bold horizontal lines) in the vertical directions of the screen. The lowermost bar indicates the state where the state of charge is lowest (that is, the amount of stored electrical energy is smallest). The state of charge increases as the number of bars increases. When the display reaches the uppermost bar, the state of charge is highest (that is, the amount of stored electrical energy is largest).

Thus, graphically displaying the state of charge of the capacitor 19 on the basic screen makes it possible for the operator to check the state of charge of the capacitor 19 substantially simultaneously while checking the basic information. Thus, the convenience of the display unit 80 is increased. Furthermore, there is no need to switch the display screen to check the state of charge of the capacitor 19, and it is possible to check the state of charge while operating an operation lever.

Furthermore, displaying the state of charge of the capacitor 19 beside the output display of the turning electric motor 21 on the same screen makes it possible for the operator to, for example, try to positively perform such a turning lever operation as to enable power generation when the state of charge is low. Furthermore, it is possible for the operator to see how the state of charge changes in the case of continuing the operator's turning operation while viewing a single display screen. Thus, the convenience of the display unit 80 is increased.

Figure 7:
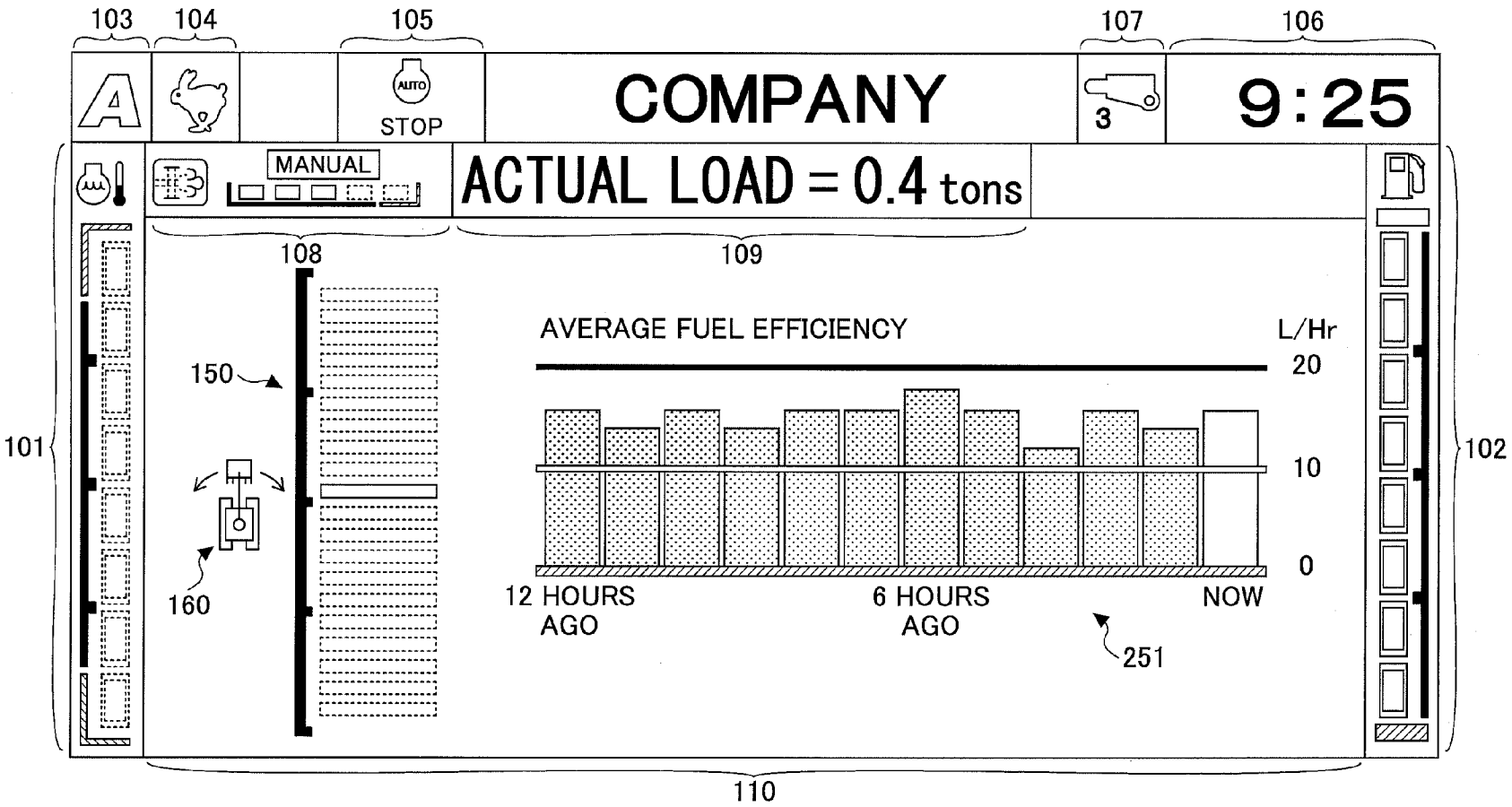
FIG. 7 is a diagram illustrating another screen displayed on the display monitor.

Next, a description is given, with reference to FIG. 7, of another example of screen display. On a display screen 200 illustrated in FIG. 7, the basic information illustrated in FIG. 6 is displayed, and the contents of display in the region 110 alone are different.

Referring to FIG. 7, in the region 110, the output of the turning electric motor 21 is displayed the same as in FIG. 6. Unlike the display screen 100 illustrated in FIG. 6, however, not the state of charge but the average fuel efficiency of the engine 11 is graphically displayed in a bar graph 251 beside the graphical display of the output of the turning electric motor 21 in the region 110.

In the case illustrated in FIG. 7, the bar graph 251 of the average fuel efficiency includes bars indicating the hour-by-hour average fuel efficiency. The bars indicating the average fuel efficiency extend vertically on the screen, and the bar length corresponds to the value of the average fuel efficiency. The current average fuel efficiency is displayed in the bar at the right end. The average fuel efficiency is displayed leftward at hourly intervals, and the average fuel efficiency of 12 hours ago is displayed at the left end.

The average fuel efficiency is determined based on a command value of the amount of fuel injection transmitted from the controller 30 to the engine 11.

Thus, displaying the past average fuel efficiency makes it possible to encourage the operator to perform a lever operation in consideration of fuel efficiency. For example, it is possible for the operator to check the transition of the hourly average fuel efficiency, and to recall various setting modes at the time of high average fuel efficiency and make a change to such settings, or to recall a lever operation at the time of high fuel efficiency and perform such a lever operation. As a result, work is performed with high average fuel efficiency for a longer time, thus making it possible to improve the fuel efficiency of the shovel.

In the case illustrated in FIG. 7, the hourly average fuel efficiency is displayed up to 12 hours ago as the past average fuel efficiency. The time interval at which the average fuel efficiency is calculated is not limited to this. For example, the daily average fuel efficiency may be displayed up to 7 days ago. Furthermore, the fuel efficiency to be displayed is not limited to the average fuel efficiency. For example, the actual operation average fuel efficiency, which is the average of the fuel efficiency determined only over a period during which the engine 11 is in actual operation, may also be displayed. Alternatively, the lever operation average fuel efficiency, which is the average of the fuel efficiency determined only over a period during which a lever is operated, may be displayed.

Thus, displaying the past average fuel efficiency on the basic screen makes it possible for the operator to check the past average fuel efficiency substantially simultaneously while checking the basic information. Thus, the convenience of the display unit 80 is increased. Furthermore, there is no need to switch the display screen to check the past average fuel efficiency, and it is possible to check the average fuel efficiency while operating an operation lever.

Furthermore, displaying the past average fuel efficiency beside the output display of the turning electric motor 21 on the same screen makes it possible to encourage the operator to perform a turning lever operation in consideration of fuel efficiency. Furthermore, it is possible for the operator to perform work while considering what turning lever operation is effective for improvement of fuel efficiency.

Figure 8:
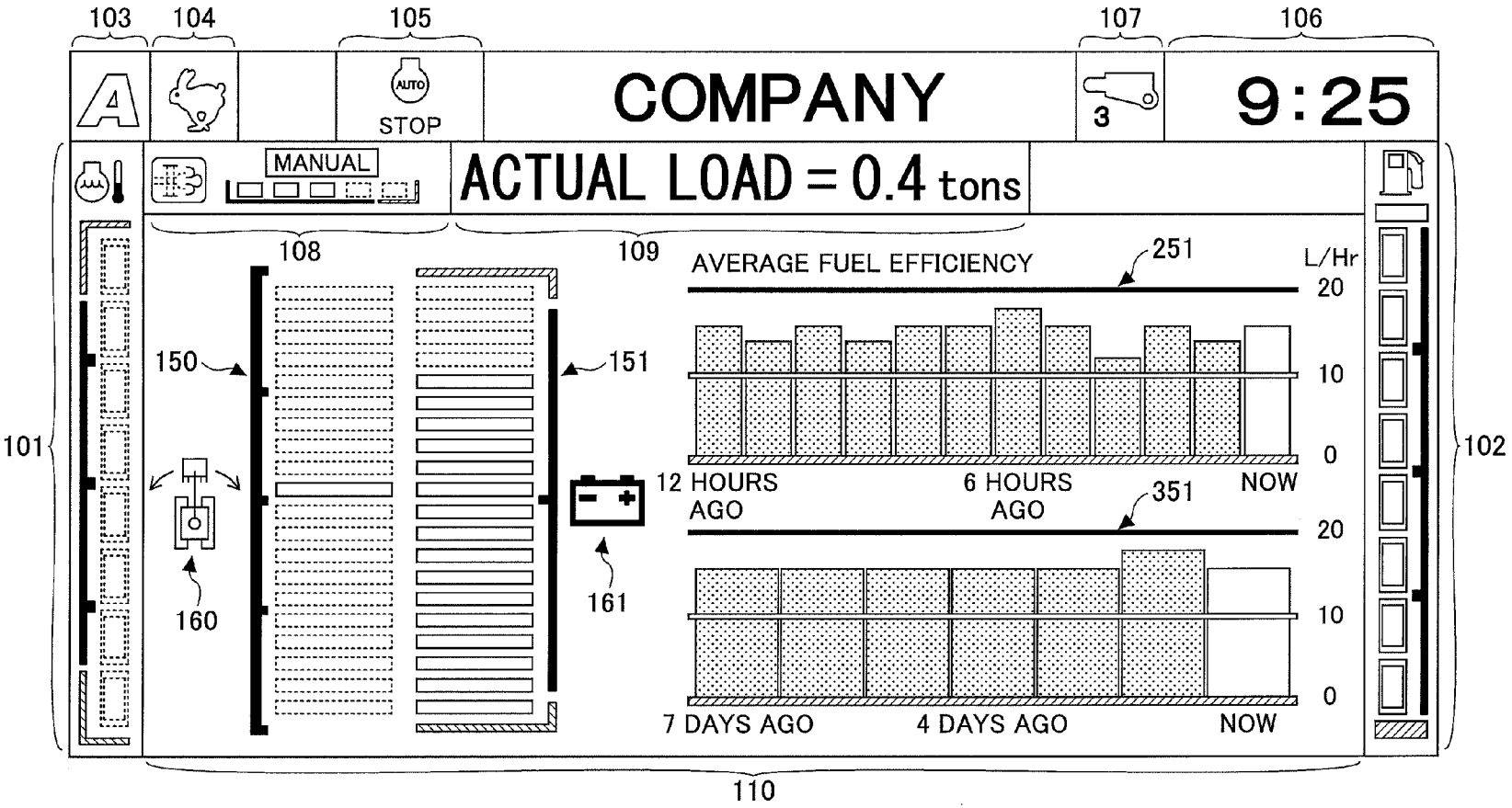
FIG. 8 is a diagram illustrating yet another screen displayed on the display monitor.

Next, a description is given, with reference to FIG. 8, of another example of screen display. On a display screen 300 illustrated in FIG. 8, the basic information illustrated in FIG. 6 is displayed, and the contents of display in the region 110 alone are different.

On the display screen 300 illustrated in FIG. 8, the bar graph 251 indicating the average fuel efficiency illustrated in FIG. 7 is additionally displayed in the region 110 of the display screen 100 illustrated in FIG. 6. Furthermore, a bar graph 351 indicating the average fuel efficiency for 7 days is displayed below the bar graph 251 indicating the average fuel efficiency for 12 hours illustrated in FIG. 7.

Thus, according to the example screen display illustrated in FIG. 8, in addition to the basic information, various kinds of information such as the output display of the turning electric motor 21, the state of charge of the capacitor 19, and the average fuel efficiency are displayed on the single display screen 300. Accordingly, it is possible for the operator to obtain a variety of information from the display monitor 42 without performing an operation to switch screens. Thus, the convenience of the display unit 80 is increased.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A shovel, comprising:

a cabin in which a display monitor is provided;

an upper-part turnable body that includes the cabin;

an electric turning mechanism that causes the upper-part turnable body to turn;

a turning electric motor that drives the electric turning mechanism;

an inverter that controls an operation of the turning electric motor;

a current sensor provided in the inverter, the current sensor detecting a state of driving of the electric turning mechanism;

a processor; and a memory storing a program that, when executed by the processor, causes the shovel to calculate electric power pertaining to an operation of the turning electric motor based on a detection value of the current sensor, the electric power varying in accordance with an operation of turning the upper-part turnable body that is being performed by an operator of the shovel, generate turning operation display data for graphically representing the calculated electric power, and cause the display monitor to graphically display the generated turning operation display data on a multilevel scale.

2. The shovel as claimed in claim 1, further comprising:

an electrical energy storage device that supplies electric power for driving the turning electric motor, wherein when executed by the processor, the program further causes the shovel to generate state of charge display data for graphically representing an amount of electrical energy stored in the electrical energy storage device, and cause the display monitor to graphically display the generated turning operation display data and the generated state of charge display data simultaneously on a single display screen.

3. The shovel as claimed in claim 2, wherein a graphical representation of the calculated electric power and a graphical representation of the amount of stored electrical energy are displayed in bar graphs that change vertically on the single display screen of the display monitor.

4. The shovel as claimed in claim 2, wherein near at least one of a graphical representation of the calculated electric power and a graphical representation of the amount of stored electrical energy, a schematic diagram representing a meaning of the at least one of the graphical representations is displayed.

5. The shovel as claimed in claim 1, wherein when executed by the processor, the program further causes the shovel to generate fuel efficiency display data for graphically representing fuel efficiency of an engine, and cause the display monitor to graphically display the generated turning operation display data and the generated fuel efficiency display data simultaneously on a single display screen.

6. The shovel as claimed in claim 5, wherein a graphical representation of the calculated electric power and a graphical representation of the fuel efficiency are displayed in bar graphs that change vertically on the single display screen of the display monitor.

7. The shovel as claimed in claim 1, wherein a graphical representation of the calculated electric power pertaining to the operation of the turning electric motor is displayed in a single direction irrespective of a turning direction of the electric turning mechanism.

8. The shovel as claimed in claim 1, wherein information on an operating condition of the shovel is displayed simultaneously with the turning operation display data on a display screen.

9. The shovel as claimed in claim 1, wherein information on a setting condition of the shovel is displayed simultaneously with the turning operation display data on a display screen.

10. The shovel as claimed in claim 1, wherein when executed by the processor, the program causes the shovel to calculate the electric power consumed by the electric turning motor when the electric turning motor is in a power running operation and calculate the electric power generated by the electric turning motor when the electric turning motor is in a regenerative operation.

11. The shovel as claimed in claim 10, wherein when executed by the processor, the program causes the shovel to cause the display monitor to graphically display the generated turning operation display data on the multilevel scale in a bar graph.

12. The shovel as claimed in claim 11, wherein the bar graph successively indicates a first output of the turning electric motor in the power running operation and a second output of the turning electric motor in the regenerative operation on the multilevel scale, the first output and the second output being indicated in first and second opposite vertical directions, respectively, from a center of the bar graph at which an output of the power running operation is zero.

* * * * *